US005080286A

United States Patent [19]

Morrison

[11] Patent Number: 5,080,286

[45] Date of Patent: Jan. 14, 1992

[54] STABLE STREAM PRODUCING FLEXIBLE ORIFICE INDEPENDENT OF FLUID PRESSURE

[75] Inventor: Andrew D. Morrison, Altadena, Calif.

[73] Assignee: The United States of America as represented by the Administrator of the National Aeronautics and Space Administration, Washington, D.C.

[21] Appl. No.: 531,434

[22] Filed: May 31, 1990

[51] Int. Cl.[5] ..... B05B 1/02; B05B 1/14

[52] U.S. Cl. ..... 239/533.13; 239/543; 239/546; 239/552; 239/602

[58] Field of Search ..... 239/533.13, 533.14, 239/DIG. 12, 546, 602, 552, 561, 562, 567, 543, 544, 548; 137/845

[56] References Cited

U.S. PATENT DOCUMENTS

| | | | |
|---|---|---|---|
| Re. 24,534 | 9/1958 | Dahl . | |
| 2,235,258 | 3/1941 | Jones | 239/544 |
| 2,389,676 | 11/1945 | Mayhew | 239/543 |
| 2,910,093 | 10/1959 | Dahl . | |
| 2,928,611 | 3/1960 | Lauderback et al. | 239/544 |
| 2,941,544 | 6/1960 | Peras . | |
| 3,130,919 | 4/1964 | Baker | 239/533.13 |
| 3,342,419 | 9/1967 | Weese | 239/533.13 |
| 3,697,002 | 10/1972 | Parkison . | |
| 3,719,328 | 3/1973 | Hindman | 239/546 |
| 4,228,956 | 10/1980 | Varner . | |
| 4,457,343 | 7/1984 | Zukausky . | |
| 4,492,339 | 1/1985 | Kreitzberg . | |

FOREIGN PATENT DOCUMENTS

| | | | |
|---|---|---|---|
| 875058 | 9/1942 | France | 239/544 |
| 2446134 | 9/1980 | France | 239/602 |
| 385737 | 1/1933 | United Kingdom | 239/533.13 |

*Primary Examiner*—Andres Kashnikow
*Assistant Examiner*—Karen B. Merritt
*Attorney, Agent, or Firm*—Thomas H. Jones; John R. Manning

[57] ABSTRACT

A self-adjusting orifice for fluids nozzle includes a membrane constructed of a single piece of flexible or elastic material. This flexible material is shaped to fit into the outlet of a nozzle. The body of the membrane has at least two flow channels, from one face to the other, which directs two streams of water to cross at the opening of the nozzle or at some point beyond. The elasticity and thickness of the membrane is selected to match the range of expected pressures and fluid velocities. The orifice may have more than two flow channels, as long as they are aligned adjacent to one another and directed towards each other at the exit face. In a three orifice embodiment, one is directed upward, one is directed downward, and the one in the middle is directed forward. In this embodiment all three fluid streams intersect at some point past the nozzle opening. Under increased pressure the membrane will deform causing the orifices to realign in a more forward direction, causing the streams to intersect at a smaller angle. This reduces the force with which the separate streams impact each other, still allowing the separate streams to unify into a single stable spiralling stream in spite of the increased pressure.

11 Claims, 3 Drawing Sheets

STABLE STREAM PRODUCING FLEXIBLE ORIFICE INDEPENDENT OF FLUID PRESSURE

ORIGIN OF THE INVENTION

The invention described herein was made in the performance of work under a NASA contract, and is subject to the provisions of Public Law 96-517 (35 U.S.C. Section 202) in which the Contractor has elected not to retain title.

TECHNICAL FIELD

The present invention relates, generally to improvements in fluid chokes, and more particularly to new and improved fluid chokes for use in liquid projecting hoses.

BACKGROUND ART

In liquid projecting hoses, such as are used by firefighters, for example, due to the natural instabilities inherent in the system, the exiting stream frequently disperses relatively close to the nozzle opening. In these applications, as well as in others, it is desirable to extend the coherent segment of the exiting liquid stream further beyond the nozzle than has been possible by prior art hose and nozzle arrangements. An extended coherent fluid stream is advantageous for many applications, but has particular advantage in the firefighting hose application to permit, where needed, more concentrated streams to be directed at a specific flame position or hot spot. Moreover, because the pressure or flow rates of the water source may be different from one site to another, or may even vary with time, a nozzle which will adjust to its pressure variations to provide the optimum stream, regardless of the source characteristics, is highly desirable.

STATEMENT OF THE INVENTION

A flexible membrane with a plurality of flow channels is placed in a fluid stream. The channels are aligned with the fluid flow and are constructed to direct their respective streams to a point of intersection. The flexibility of the membrane is selected to match the range of expected pressures and fluid velocity. The membrane flexes under increased pressure causing the flow channels to point in a more forward direction. As a result, the individual streams of fluid will cross at a smaller angle. This change of angle reduces the force with which the streams intersect, allowing the streams to continue to unify into a single stable spiralling stream even under greatly increased pressure.

BRIEF DESCRIPTION OF THE DRAWINGS

The exact nature of this invention, as well as its objects and many advantages, will be readily appreciated as they become better understood by reference to the following detailed description when considered in conjunction with the accompanying drawings in which like reference numerals designate like parts throughout the figures thereof, and wherein.

DETAILED DESCRIPTION OF THE INVENTION

Figure 1:
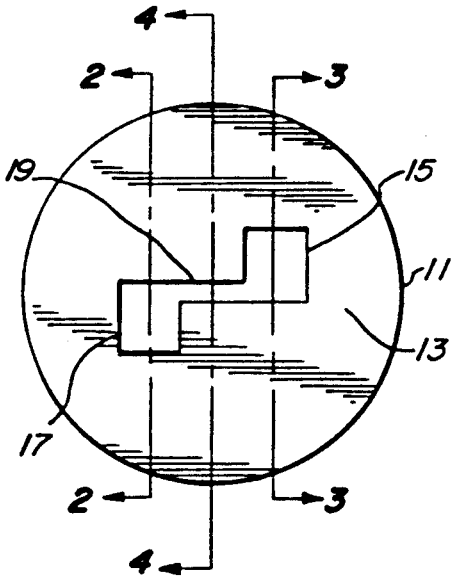
FIG. 1 is a front elevation of a preferred embodiment of the invention.

FIG. 1 illustrates a preferred embodiment of an orifice constructed according to the principals of the present invention wherein the body 11 of the orifice comprises a relatively thick, but flexible membrane. The membrane 11 may have two or three juxtaposed flow channels in the center thereof. FIG. 1 illustrates the exit apertures for the flow channels 15, 17 and 19 on the front face 13 of membrane 11.

Figure 2:
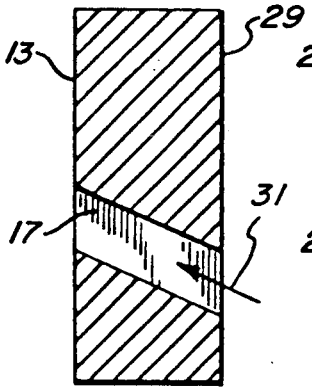
FIG. 2 is a section of the device of FIG. 1 taken along line 2—2.
Figure 3:
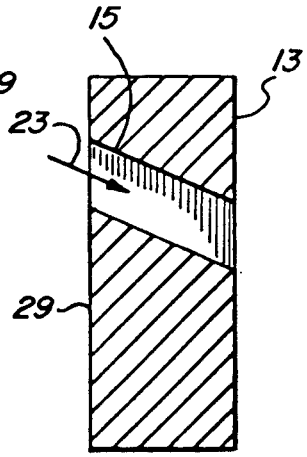
FIG. 3 is a section of the device of FIG. 1 taken along line 3—3.
Figure 4:
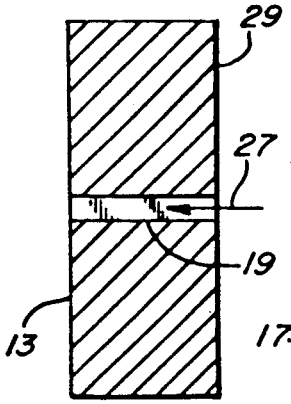
FIG. 4 is a section of the device of FIG. 1 taken along line 4—4.

FIGS. 2, 3 and 4 are cross-sections taken along section lines 2, 3 and 4 of FIG. 1. FIG. 2 shows flow channel 17 with a fluid flow arrow 31 illustrating the direction of fluid flow from the back side 29 of membrane 11 to the front side 13. FIG. 3 shows, in cross-section, flow channel 15, with fluid flow direction arrow 23 illustrating the direction of fluid flow from the backside 29 to the front side 13 of the member 11. FIG. 4 illustrates channel 19, the flow arrow 27 indicating the direction of fluid flow from the back side 29 to the front side 13.

Figure 5:
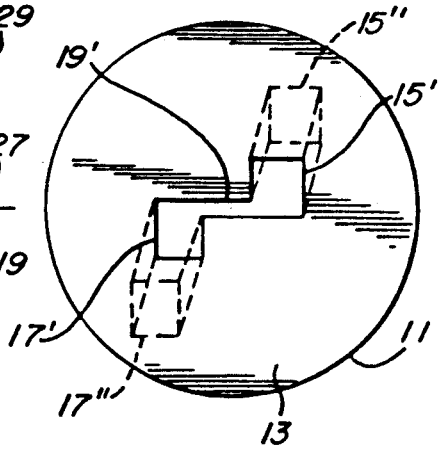
FIG. 5 is a front elevation illustrating a preferred internal channel structure.

FIG. 5 illustrates the unitary exit aperture formed by the individual exit apertures 15', 19', and 17' in the front face of membrane 11. The entrance apertures 15" and 17" on the back side of membrane 11 and the fluid channels 15 and 17 respectively, connecting the entrance apertures to the exit apertures, is shown in hidden lines.

Figure 6:
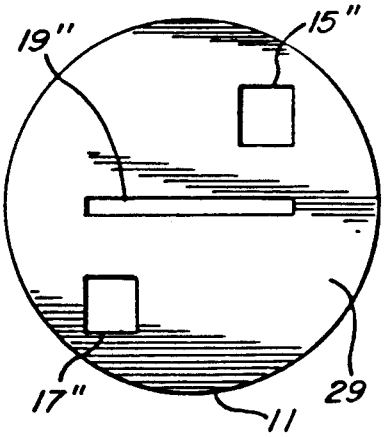
FIG. 6 is a back elevation of the device in FIG. 5.

FIG. 6 illustrates the back side 29 of membrane 11 and the flow channel entrance apertures 15", 17" and 19". As can be seen from FIGS. 1 through 6, the back face 29 of membrane 11 contains three separate entrance apertures 15", 17" and 19" while the front face 13 of membrane 11 contains a single aperture that is the result of the merger of the three exit apertures 15', 17' and 19'.

Figure 7:
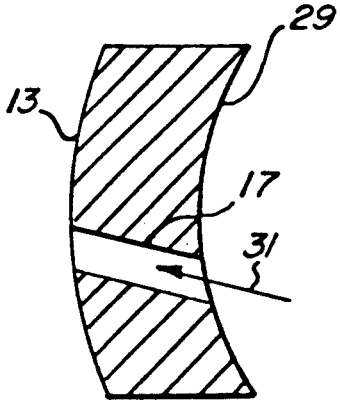
FIG. 7 is the section of in FIG. 2 with fluid forces acting on it.
Figure 8:
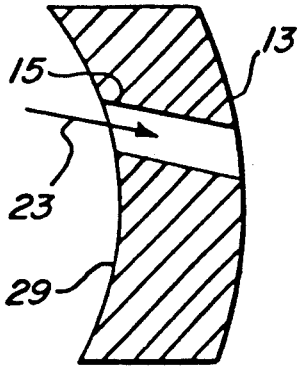
FIG. 8 is the section of FIG. 3 with fluid forces acting on it.
Figure 9:
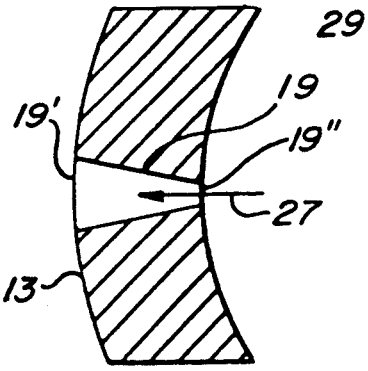
FIG. 9 is the section of FIG. 4 with fluid forces acting on it.

Referring now to FIGS. 7, 8 and 9, the self-adjustable nature of the orifice is illustrated. Use of a flexible material for membrane 11 will cause it to distort in a concave manner, as illustrated in FIGS. 7, 8 and 9 when fluid pressure impacts the back side 29. The angle of fluid flow through channel 17 in the direction of flow arrow 31 to the front face 13 of the membrane will change as a result of this deformation. The fluid flow through channel 17 will be in a more forward direction. Likewise, as shown in FIG. 8, flow channel 15, which is pointed downwardly, will also move to a smaller angle of incidence.

Referring now to FIG. 9, the central channel 19 will deform, as illustrated, due to fluid pressure acting on the back side 29 causing it to form a somewhat concave curvature, on the back side 29 and a convex curvature on the front side 13, as shown. The entrance aperture 19" will tend to get smaller, the exit aperture 19' on the face 13 will tend to get larger, as illustrated. The fluid flow direction will not change, however.

Figure 10:
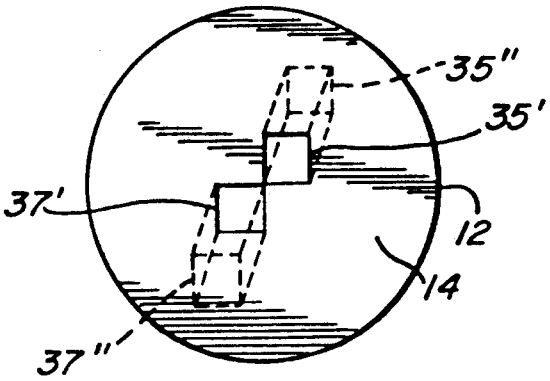
FIG. 10 is a front elevation showing internal channel construction of an alternate preferred embodiment.
Figure 11:
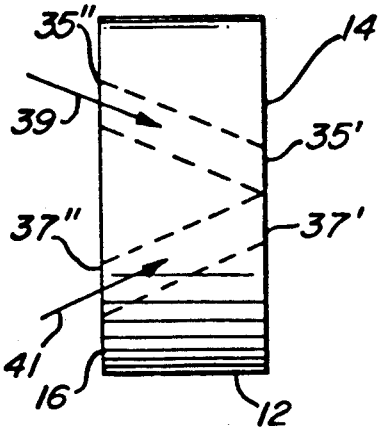
FIG. 11 is a side elevation of the device of FIG. 10.

Referring now to FIGS. 10 and 11, an alternate preferred embodiment of an adjustable orifice according to the present invention, is illustrated. FIG. 10 illustrates a two-channel orifice having a membrane 12 with a first exit aperture 35' intersecting a second exit aperture 37' on its front side 14. These exit apertures on the front side 14 are connected by channels to two entrance apertures 35" and 37" on the back side 16 of the membrane 12. The direction of fluid flow through the channels is indicated by flow arrows 39 and 41. This particular construction will cause two fluid streams to intersect at the front side 14 of the membrane 12.

Figure 12:
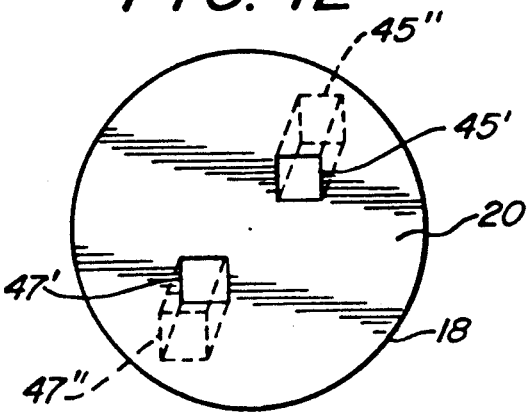
FIG. 12 is a front elevation showing internal channel construction of another preferred embodiment.
Figure 13:
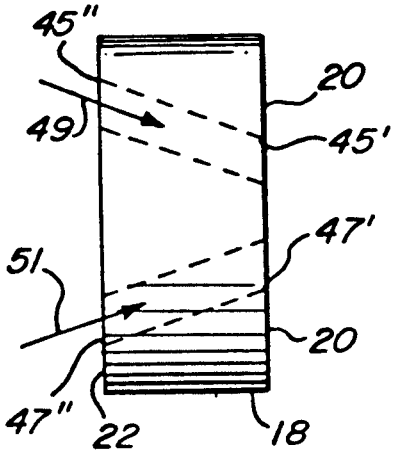
FIG. 13 is a side elevation of the device of FIG. 12.

Referring now to FIGS. 12 and 13, another alternate preferred embodiment according to the present invention, is illustrated. This embodiment includes a two-channel orifice having a membrane 18 wherein the exit apertures 45' and 47' on the front side 20 of the membrane do not intersect. The spacing between the entrance apertures 45" and 47" on the back side 22 of the membrane 18 is greater than the spacing between the exit apertures 45' and 47' on the front side 20. This causes the fluid streams, as indicated by flow arrows 49 and 51 to intersect. In this instance the intersection will occur at some point beyond the front side 20 of the membrane 18.

Figure 14:
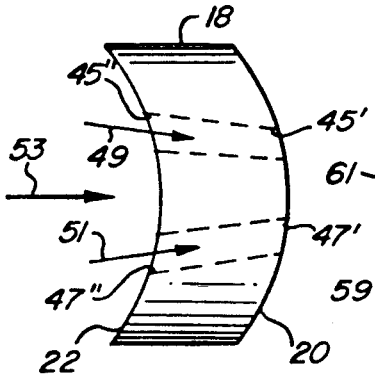
FIG. 14 is the elevation of FIG. 13 with fluid pressure acting on it.

FIG. 14 illustrates the self-adjusting function of the orifice due to the flexible material used for membrane 18. When operating under high pressure flow 53 the membrane 18 will deform as illustrated. This causes the channels 45 and 47 in the membrane to be redirected into a lesser angle. The fluid flow in the direction of flow arrows 49, and 51 through channels 45 and 47 will thereby be directed at each other at a smaller angle.

Figure 15:
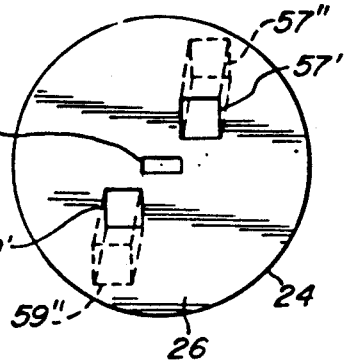
FIG. 15 is a front elevation showing internal channel construction of yet another preferred embodiment.
Figure 16:
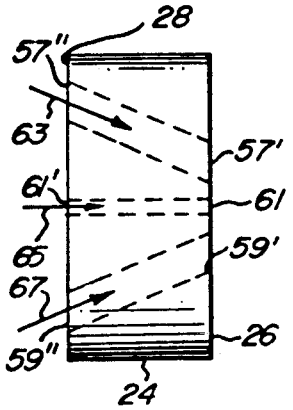
FIG. 16 is a side elevation of the device of FIG. 15.

Referring now to FIGS. 15 and 16, yet another preferred embodiment of the present invention is illustrated. The orifice includes a membrane 24 having three separate channels 57, 59 and 61. The exit apertures 57', 59' and 61' on the front side 26 of membrane 24 do not intersect. They are spaced apart from each other. The entrance apertures 57", 61" and 59" on the back side 28 of membrane 24 are spaced apart from each other at a distance that is greater than the distance between the exit apertures 57', 61' and 59'. The fluid flow through apertures 57, 61 and 59 will be in the direction indicated by flow arrows 63, 65 and 67 respectively.

Figure 17:
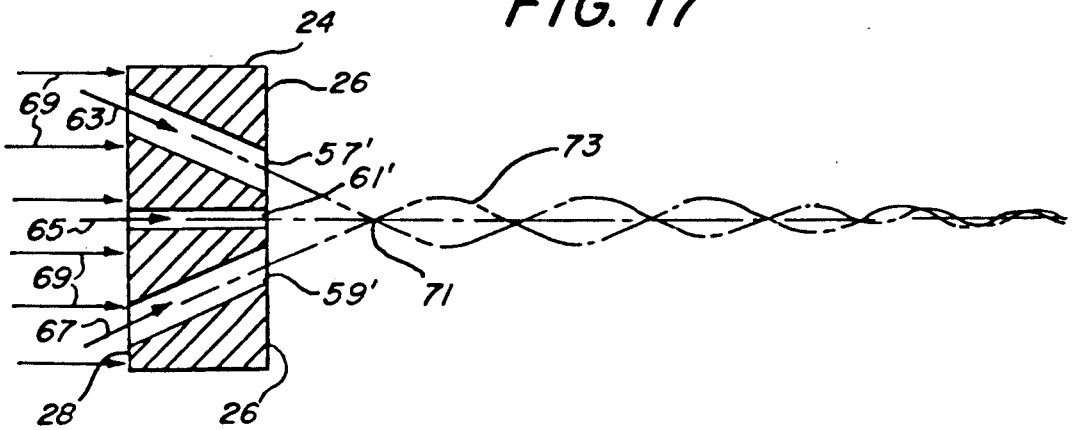
FIG. 17 is a diagrammatic illustration of the device of FIG. 15 illustrating the flow of fluid through the channels.
Figure 18:
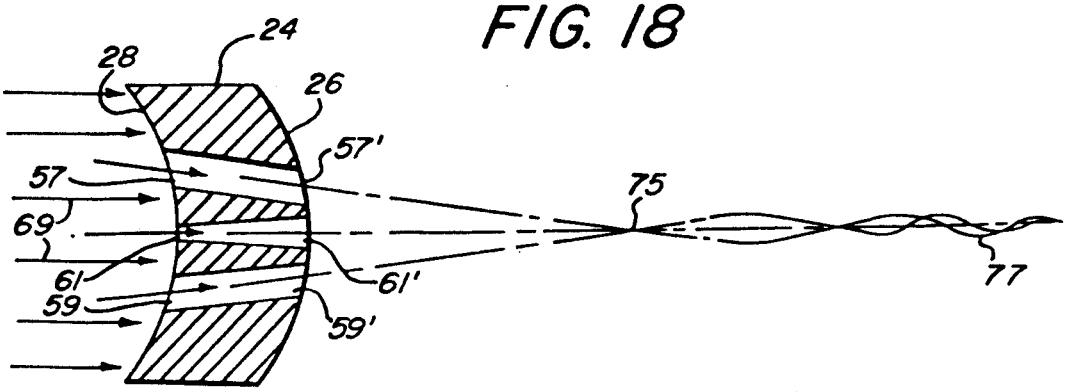
FIG. 18 is a diagrammatic illustration of the device of FIG. 15 illustrating the flow of fluid through the channels when the device is under considerable pressure.

Referring now to FIGS. 17 and 18, the functional operation of the orifice of FIGS. 15 and 16 is illustrated. This is also an illustration of the operative concepts of all the other embodiments that have been described so far. The membrane 24 having channels 57, 61 and 59 therethrough is placed into a fluid flow stream in a typical water hose nozzle, for example. The back side 28 of membrane 24 blocks the water flow 69 and passes only water streams 63, 65 and 67 through the entrance apertures to the exit apertures 57', 61' and 59' on the downstream or front side 26 of membrane 24. The three streams 63, 65 and 67, because of the flow channels, are angled toward each other and tend to converge at a point 71. The tendency of the center stream 65 out of exit aperture 61' is to pull the diverging streams 63, and 67 together beyond the intersection point 71, causing a stable spiralling stream 73 thereafter a cross-section of this spiralling stream would be a dog-bone shape. FIG. 17 illustrates the function of the flexible membrane 24 when being acted upon with minimal flow pressure from the fluid flow 69. This is an unloaded condition.

FIG. 18 illustrates the membrane 24 in a loaded condition. The fluid flow 69 has increased to the point where the membrane is being stretched into a concave shape, as illustrated. As a result, the three channels 57, 61 and 59 are redirected causing the flow streams exiting apertures 57', 61' and 59' to diverge less than in the unloaded condition of FIG. 17. This causes an intersection point 75 at a greater distance from the face 26 of orifice 24. But more important, the smaller angle of the streams reduces the force with which the streams impact each other and pull apart from each other, thereby still allowing the central stream exiting aperture 61' to pull the two outside streams together and create the stable spiralling stream 77 thereafter.

If membrane 24 did not function in this manner to balance the force that tends to pull the streams apart, rather than a spiralling stream after the intersection point 75 one would see a fan shaped diverging stream.

What has been described, is a self-adjusting orifice for a fluids nozzle which- comprises an orifice that may be cut or molded from a single piece of flexible or elastic material and inserted into the outlet of a nozzle. The elasticity and thickness of the orifice material is selected to complement an expected range of pressures and fluid flow velocities. The orifice is a complex membrane structure which may have three separate or interconnected apertures aligned adjacent to one another. In the passive condition, these apertures are directed respectfully upward, downward or forward. When water flows through the apertures at higher pressures, the membrane distorts causing the outer apertures to align more nearly with the central or forward directing aperture, thereby continuing to balance the forces of the fluid flow exiting these apertures.

I claim:

1. A self-adjusting orifice for a fluids nozzle, comprising:

a flexible membrane placed in the path of fluid flow for said nozzle;

said membrane having a plurality of flow channels in the direction of fluid flow, said flow channels passing through said membrane with entrance apertures and exit apertures, the channels being angled to cause intersection of the individual fluid streams exiting said apertures into a single stable spiralling stream;

whereby an increase in fluid velocity causes said flexible membrane to deform and reduce the angle of incidence of the intersecting fluid streams, allowing the streams to continue to unify into a single stable spiralling stream.

2. The self-adjusting orifice of claim 1 wherein said membrane has a flat front and back, with its flat back being impacted by said fluid flow and its flat front exiting the fluid streams.

3. The self-adjusting orifice of claim 2 wherein said membrane deforms by bulging into a concave shape in the direction of fluid flow.

4. The self-adjusting orifice of claim 1 wherein said membrane has two flow channels in the center of the membrane, the entrance apertures for said channels on one face of said membrane being spaced apart, and the exit apertures of said channels on another face of said membrane being adjacent and touching at least at one point.

5. The self-adjusting orifice of claim 4 wherein said channels are square in cross-sections.

6. The self-adjusting orifice of claim 1 wherein said membrane has two flow channels in the center of the membrane, the entrance apertures for said channels on one face of said membrane being spaced apart a first distance, and the exit apertures of said channels on another face of said membrane being spaced apart a second distance which is less than said first distance.

7. The self-adjusting orifice of claim 1 wherein said membrane has three flow channels, a first channel located in the center of said membrane, the second and third channels being spaced from said first channel, the entrance apertures for said second and third channels being spaced from the entrance aperture for said first channel by a first distance, and the exit apertures for said second and third channels being spaced from the exit aperture of said first channel by a second distance which is less than said first distance.

8. The self-adjusting orifice of claim 7 wherein said first, second and third exit apertures intersect at an exit side of said membrane.

9. The self-adjusting orifice of claim 8 wherein said first channel is rectangular, and said second and third channels are square.

10. The self-adjusting orifice of claim 8 wherein said membrane has a flat front and back with its flat back being impacted by said fluid flow and its flat front exiting the fluid streams.

11. The self-adjusting orifice of claim 10 wherein said membrane deforms by bulging into a concave shape in the direction of fluid flow.

* * * * *